US011096454B2

(12) United States Patent
Wang et al.

(10) Patent No.: US 11,096,454 B2
(45) Date of Patent: Aug. 24, 2021

(54) DOUBLE-SIDED USABLE BELT BUCKLE AND BELT THEREOF

(71) Applicant: QING CAN XING HARDWARE CRAFTS CO., LTD., Quanzhou (CN)

(72) Inventors: Nianqing Wang, Quanzhou (CN); Jindang Wang, Quanzhou (CN)

(73) Assignee: QING CAN XING HARDWARE CRAFTS CO., LTD., Quanzhou (CN)

( * ) Notice: Subject to any disclaimer, the term of this patent is extended or adjusted under 35 U.S.C. 154(b) by 0 days.

(21) Appl. No.: 16/896,183

(22) Filed: Jun. 8, 2020

(65) Prior Publication Data

US 2021/0093052 A1 Apr. 1, 2021

Related U.S. Application Data

(63) Continuation of application No. PCT/CN2020/070496, filed on Jan. 6, 2020.

(30) Foreign Application Priority Data

Sep. 30, 2019 (CN) ..... 201910943500.1

(51) Int. Cl.
*A44B 11/25* (2006.01)
*A41F 9/00* (2006.01)

(52) U.S. Cl.
CPC ..... *A44B 11/2592* (2013.01); *A41F 9/00* (2013.01)

(58) Field of Classification Search
CPC ... A44B 11/06; A44B 11/2592; A44B 11/006; A41F 9/00
See application file for complete search history.

(56) References Cited

U.S. PATENT DOCUMENTS 1,737,246 A * 11/1929 Jones ..... A44C 5/2047 24/616
4,161,806 A * 7/1979 Hennisse ..... A41F 1/006 24/586.11
4,217,681 A * 8/1980 Grohoski ..... A44C 5/14 224/164
4,281,440 A * 8/1981 Britz ..... A44B 11/006 24/163 FC
4,406,043 A * 9/1983 Friedman ..... A44B 11/006 24/171
4,458,390 A * 7/1984 Fogelson ..... A44B 11/006 24/182
4,825,515 A * 5/1989 Wolterstorff, Jr. ... A44B 11/263 24/196

(Continued)

*Primary Examiner* — Jason W San

(57) ABSTRACT

The present invention provides a double-sided usable belt buckle, a belt having the double-sided usable belt buckle can be available on both sides. The two ends of the pin shaft can be connected with the buckle and the tail clamp by matching the clamping block arranged on the pin shaft with the clamping groove. The clamping block extends into the pin shaft mounting hole firstly, and after the connecting convex block is clamped into the connecting groove, the clamping block can be clamped into the clamping groove. When it is needed to use the other side of the belt having the double-sided usable belt buckle, simply pressing the pin shaft to make the clamping block slide out of the clamping groove so as to separate the tail clamp from the buckle, and then replace the tail clamp and connect it with the buckle again.

10 Claims, 10 Drawing Sheets

(56) References Cited

U.S. PATENT DOCUMENTS

| | | | | | |
|---|---|---|---|---|---|
| 5,191,685 | A * | 3/1993 | Aoki | A44C 5/2052 | 24/265 WS |
| 5,485,659 | A * | 1/1996 | Kashikie | A44C 5/2052 | 24/71 J |
| 5,787,554 | A * | 8/1998 | Hashimoto | A44C 5/185 | 24/265 WS |
| 5,806,148 | A * | 9/1998 | McFalls | A44B 11/2561 | 24/168 |
| 6,389,653 | B1 * | 5/2002 | Matoba | A44B 11/006 | 24/265 AL |
| 7,480,967 | B2 * | 1/2009 | Kojoori | A44B 11/006 | 2/322 |
| 8,056,191 | B2 * | 11/2011 | Crye | A44B 11/10 | 24/197 |
| 9,173,454 | B2 * | 11/2015 | Liu | A44B 11/006 | |
| 9,591,899 | B2 * | 3/2017 | Catanese | A44C 5/246 | |
| 9,930,936 | B2 * | 4/2018 | Liu | A44B 11/006 | |
| 2012/0248793 | A1 * | 10/2012 | Fiedler | A44B 11/2592 | 292/163 |
| 2014/0215766 | A1 * | 8/2014 | Liu | A44B 11/006 | 24/188 |
| 2014/0298630 | A1 * | 10/2014 | Hortnagl | A44B 11/2519 | 24/697.2 |
| 2016/0000191 | A1 * | 1/2016 | Haider | A44B 11/2592 | 24/186 |
| 2016/0374436 | A1 * | 12/2016 | Park | A44B 11/25 | 24/615 |
| 2018/0289113 | A1 * | 10/2018 | Chu | A44B 11/266 | |
| 2020/0022463 | A1 * | 1/2020 | Templeton | A44B 11/2592 | |
| 2020/0085149 | A1 * | 3/2020 | Soung | A41F 9/025 | |
| 2020/0121032 | A1 * | 4/2020 | Vaccari | A44B 11/266 | |
| 2020/0352285 | A1 * | 11/2020 | Wang | A44B 11/24 | |
| 2021/0022454 | A1 * | 1/2021 | Dong | A44B 11/24 | |

* cited by examiner

DOUBLE-SIDED USABLE BELT BUCKLE AND BELT THEREOF

CROSS REFERENCE OF RELATED APPLICATIONS

The present application is a continuation-application of International (PCT) Patent Application No. PCT/CN2020/070496 filed on Jan. 6, 2020, which claims foreign priorities of Chinese Patent Application No. CN201910943500.1, filed on Sep. 30, 2019, the entire contents of which are hereby incorporated by reference.

TECHNICAL FIELD

The present invention relates to a technical field of belt accessories, in particulars to a double-sided usable belt buckle and a belt.

BACKGROUND

Nowadays, with the prosperity of industry and the prosperity of people's livelihood, clothes people wear represent an overall image and spiritual symbol of individuals. While belts are important accessories of clothing, which is used for expressing beauty and is also used for decorating. With the improvement of people's pursuit of the beauty, the clothing accessories are more and more diversified. Therefore, a single-sided belt does not meet needs of people, double-sided belts came into being.

In general, if patterns of the belt needs to be replaced, the belt head needs to be removed first to replace the belt or the belt head. This process is complex and not universal.

In the prior art of a technical field of the belts, there is an urgent need of a belt buckle, the belt buckle is required to be stable, quickly installed and quickly turned over, so that both sides of the belt are usable.

SUMMARY

An object of the present disclosure is to provide a double-sided usable belt buckle and a belt thereof.

In order to achieve object, the present disclosure provides a double-sided usable buckle, including a buckle head, a tail clamp, a pin shaft and a pin shaft mounting hole. A connecting convex block is disposed on the tail clamp in a direction of the buckle head. A clamping groove is disposed on the connecting convex block. A connecting groove is disposed on the buckle head 1, and the connecting groove 11 is matched with the connecting convex block. The pin shaft mounting hole is disposed on the buckle head, and the pin shaft mounting hole is communicated with the connecting groove, the pin shaft is inserted into the pin shaft mounting hole. Clamping blocks are disposed on the pin shaft. When the buckle head is connected with the tail clamp, the clamping blocks are inserted into the pin shaft mounting hole, the connecting convex block is inserted into the connecting groove. The clamping blocks are clamped into the clamping groove to fix the tail clamp.

Furthermore, a number of the clamping blocks is at least two. The clamping blocks are disposed on the pin shaft. Passing grooves are disposed on the connecting convex block for clamping blocks, and the clamping blocks are inserted into the clamping groove through the passing grooves.

Furthermore, each of the clamping blocks includes a guiding structure, when the connecting convex block is inserted into the connecting groove, the guiding structure is connected with a side wall of the connecting convex block and a side wall of corresponding passing groove to guide the clamping blocks to clamp into the clamping groove.

Furthermore, the double-sided usable belt includes a reset device, the reset device drives the pin shaft to reset after the pin shaft moves in an axial direction. When the pin shaft moves, the clamping blocks pop out of the clamping groove. And when the pin shaft is reset, the clamping blocks are clamped into the clamping groove.

Furthermore, the reset device includes a spring and a fixing base, the fixing base is connected with the buckle head. A spring receiving groove is disposed on the fixing base, and the spring is disposed inside the spring receiving groove. A center line of the pin shaft mounting hole and a center line of the spring receiving groove are coincided.

Furthermore, the double-sided usable belt includes a limiting device, the limiting device is disposed between the pin shaft and the buckle head to limit the pin shaft.

Furthermore, the limiting device includes a limiting pin and a limiting hole, and the limiting pin is fixedly connected with the pin shaft. The limiting hole is disposed on the buckle head and is communicated with the pin shaft mounting hole. The limiting pin is disposed inside the limiting hole.

Furthermore, the double-sided usable belt buckle includes a positioning device, the positioning device is disposed between the buckle head and the tail clamp.

Furthermore, the positioning device includes a positioning block and a positioning slot, and the positioning slot is matched with the positioning block. The positioning block is disposed on the tail clamp, and the positioning slot is disposed on the buckle head.

Furthermore, the present disclosure provides a belt, including a belt body and the double-sided usable belt buckle. The belt body is connected with the tail clamp of the double-sided usable belt buckle.

Based on above, and compared with the prior art, the present disclosure provides the double-sided usable belt buckle and the belt. The buckle head of the double-sided usable belt buckle and the tail clamp are fixed through matching the clamping blocks with the clamping groove. The clamping blocks are disposed on the pin shaft. When one side of the double-sided usable belt buckle is used, the clamping blocks are inserted into the pin shaft mounting hole, and after the connecting convex block is clamped into the connecting groove, the clamping blocks are clamped into the clamping groove. When another side of the double-sided usable belt buckle is used, the pin shaft is pressed to make the clamping blocks slide out of the clamping groove so that the tail clamp is separated from the buckle head. Then the tail clamp is changed to another side and connects with the buckle head again. The operation above is simple and convenient, and the double-sided usable belt buckle is quickly installed and disassembled to make both sides of the belt buckle usable.

DETAILED DESCRIPTION

The technical solution in the present disclosure is clearly and completely described below in connection with accompanying drawings of condiments of the present disclosure. Obviously, the described condiments are merely parts of the present disclosure and not all condiments. Based on the condiments of the present disclosure, those of ordinary skill in the art who obtain other all condiments without making any inventive faculty, fall within the scope of the present invention.

It is to be noted that terms "includes", "including", as well as any variations thereof, are intended to cover a non-exclusive inclusion. For example, a process, method, system, product, or apparatus which includes a listed steps or units should be not limited by the listed steps or units, but may include other steps or units not expressly listed or inherent to such process, method, article, or apparatus.

Embodiment 1

Figure 1:
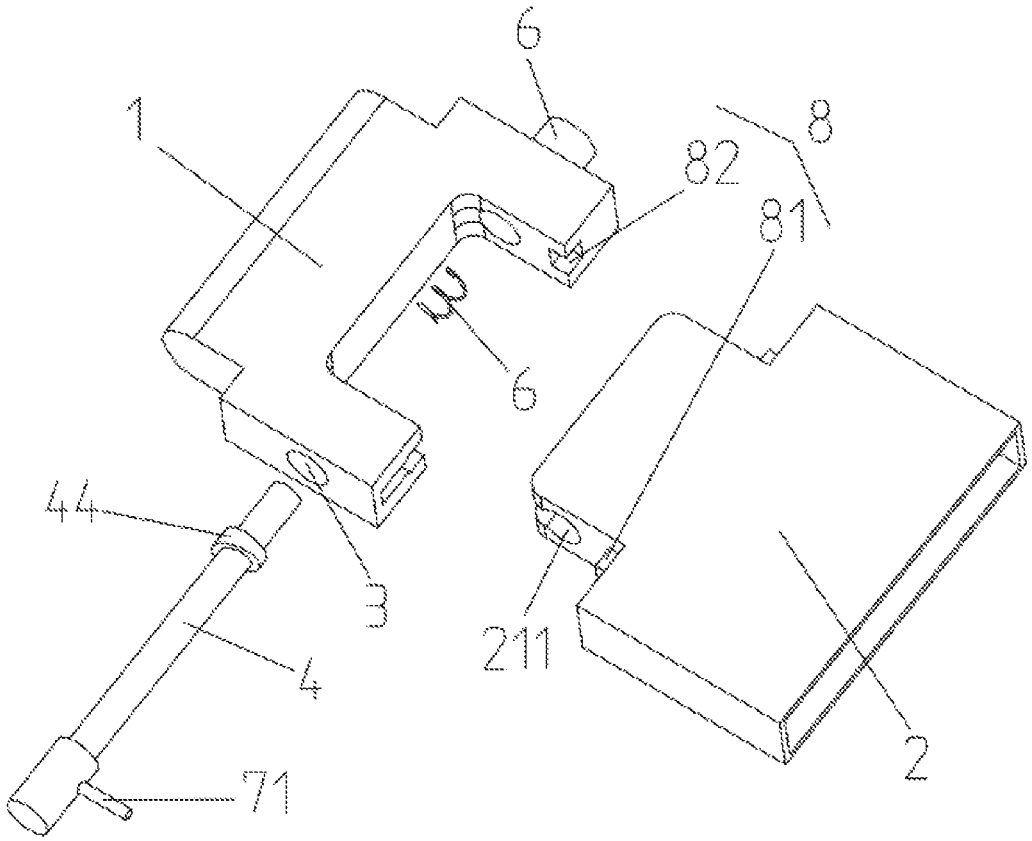
FIG. 1 is an exploded schematic diagram according to a first embodiment of a double-sided usable belt buckle of the present disclosure.
Figure 2:
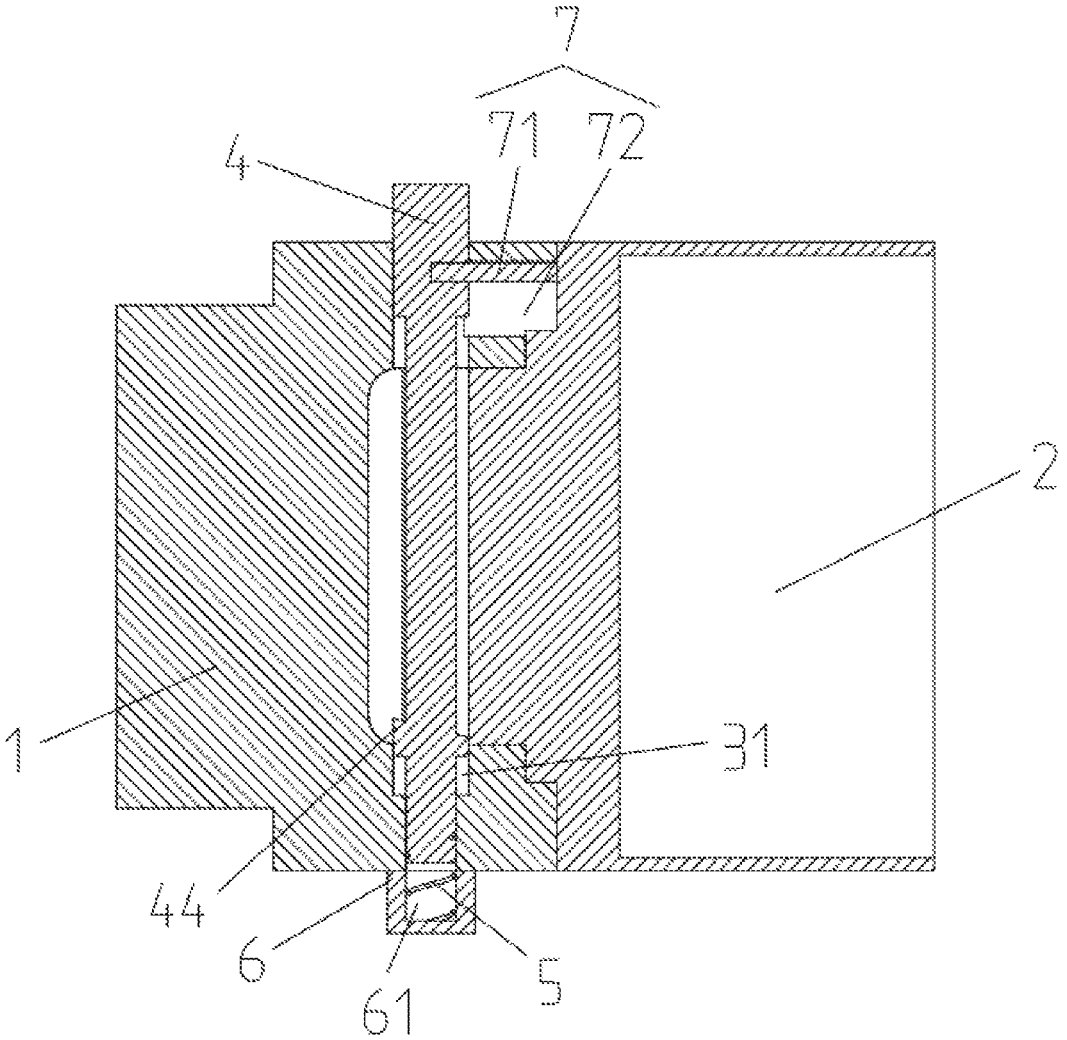
FIG. 2 is a cross-sectional schematic diagram according to the first embodiment of the double-sided usable belt buckle where the double sided usable belt buckle is in a clamping state.
Figure 3:
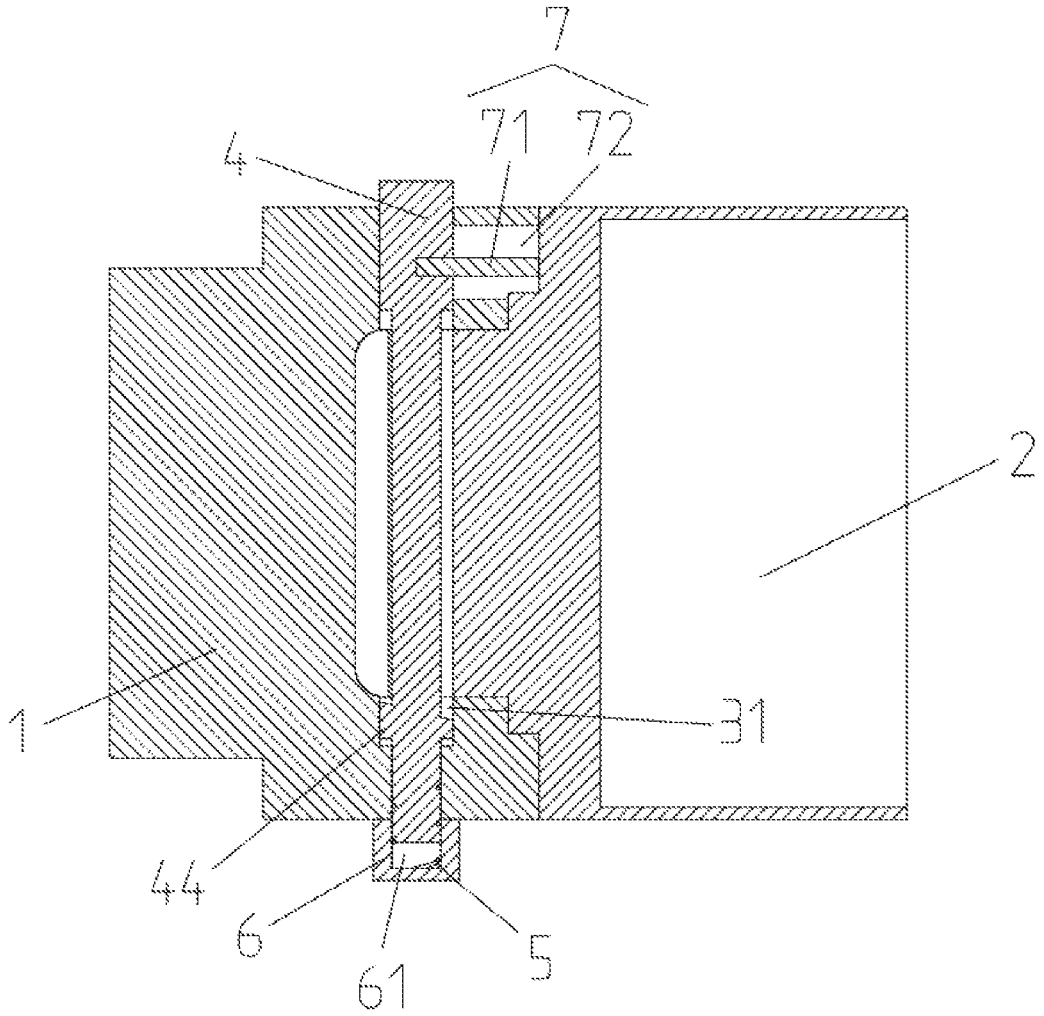
FIG. 3 is a schematic diagram according to the first embodiment of a position of a first clamping block and a second clamping block when a tail clamp is separated from the a buckle head of the double sided usable belt buckle.
Figure 4:
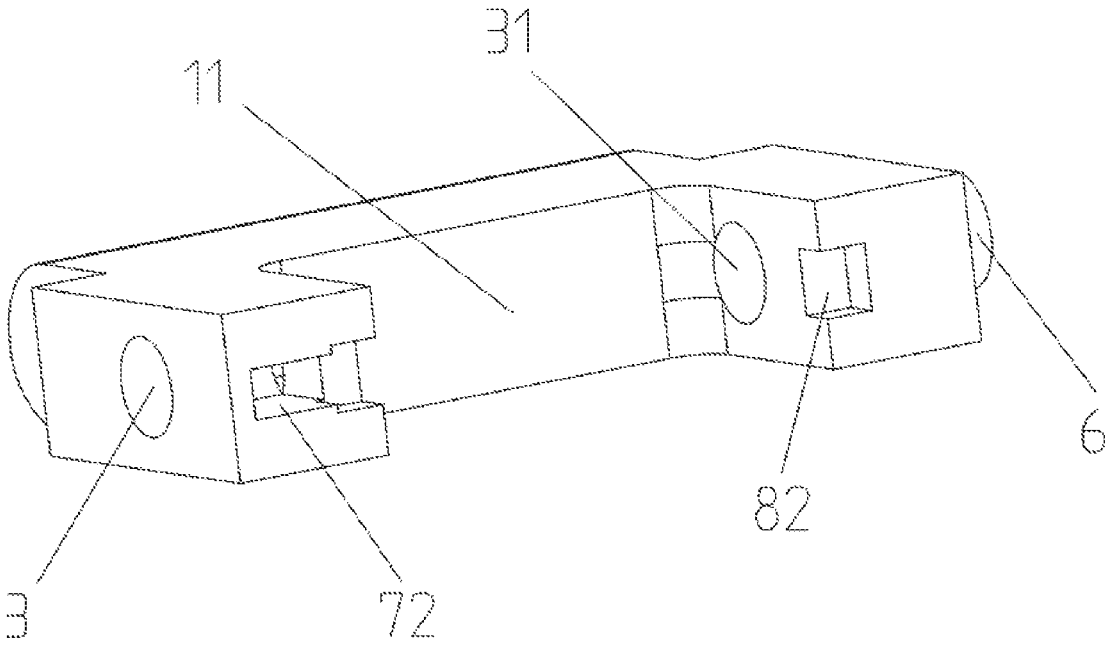
FIG. 4 is a structural schematic diagram according to the first embodiment of a buckle head of the double-sided usable belt buckle.
Figure 5:
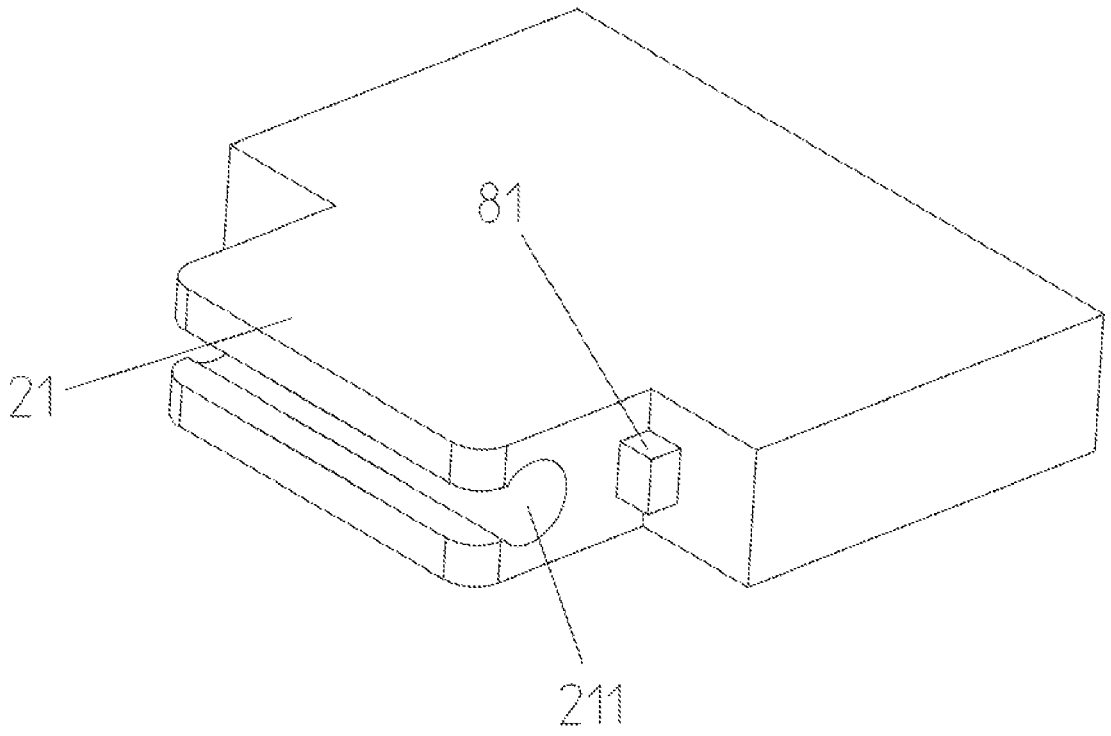
FIG. 5 is a structural schematic diagram according to the first embodiment of a tail clamp of the double-sided usable belt buckle.
Figure 6:
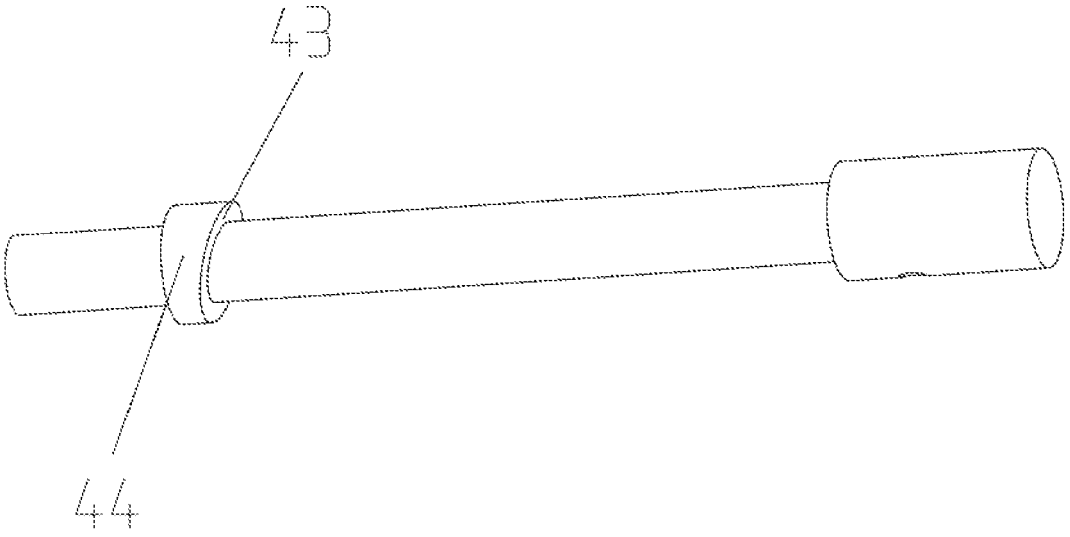
FIG. 6 is a structural schematic diagram according to the first embodiment of a pin shaft of the double-sided usable belt buckle.

As shown in FIGS. 1-6, the present disclosure provides a double-sided usable belt buckle, including a buckle head 1, a tail clamp 2, a pin shaft 4, and a pin shaft mounting hole 3. A connecting convex block 21 is disposed on the tail clamp 2 in a direction of the buckle head 1. A clamping groove 211 is disposed on the connecting convex block 21. A connecting groove 11 is disposed on the buckle head 1, and the connecting groove 11 is matched with the connecting convex block 21 The pin shaft mounting hole 3 is disposed on the buckle head 1, and the pin shaft mounting hole 3 is communicated with the connecting groove 11. The pin shaft 4 is inserted into the pin shaft mounting hole 3. Clamping blocks 44 are disposed on the pin shaft 4. When the buckle head 1 is connected with the tail clamp 2, the clamping block 44 is inserted into the pin shaft mounting hole 3, the connecting convex block 21 is inserted into the connecting groove 11, and then the clamping block 44 is clamped into the clamping groove 211 to fix the tail clamp 2. The buckle head 1 of the double-sided usable belt buckle and the tail clamp 2 are fixed through matching the clamping block 44 with the clamping groove 211. The clamping block 44 is disposed on the pin shaft 4. When one side of the double-sided usable belt buckle is used, the clamping block 44 is inserted into the pin shaft mounting hole 3, and after the connecting convex block 21 is clamped into the connecting groove 11, the clamping block 44 is clamped into the clamping groove 211. When another side of the double-sided usable belt buckle is used, the pin shaft 4 is pressed to make the clamping block 44 slide out of the clamping groove 211 so that the tail clamp 2 is separated from the buckle head 1. Then the tail clamp 2 is changed to another side and connects with the buckle head 1 again. The operation above is simple and convenient, and the double-sided usable belt buckle is quickly installed and disassembled to make both sides of the belt buckle usable.

The double-sided usable belt further includes a reset device 5, the reset device 5 drives the pin shaft 4 to reset after the pin shaft 4 moves in an axial direction. When the pin shaft 4 moves, the clamping block 44 pop out of the clamping groove 211, and when the pin shaft 4 is reset, and the clamping block 44 is clamped into the clamping groove 211. The reset device 5 includes a spring, one end of the spring is connected with the pin shaft 4, when the connecting convex block 21 is inserted into the connecting groove 11, the spring pushes the clamping block 44 out of the pin shaft mounting hole 3 and clamps the clamping block 44 into the clamping groove 211.

A release groove 31 is disposed on the pin shaft mounting hole 3. When the buckle head 1 is connected with the tail clamp 2, the pin shaft 4 is pressed to make the clamping block 44 insert into the release groove 31, so that the clamping block 44 does not block the connecting convex block 21 from inserting into the connecting groove 11.

The clamping blocks 44 includes a guiding structure 43, when the connecting convex block 21 is inserted into the connecting groove 11, the guiding structure is connected with a side wall of the connecting convex block 21 to guide the clamping block 44 to clamp into the clamping groove 211.

A fixing base 6 is disposed on the buckle head 1, and the fixing base 6 is fixedly connected with the buckle head 1. A spring receiving groove 61 is disposed on the fixing base 6, and the spring is disposed inside the spring receiving groove 61. One end of the spring is connected with the pin shaft 4, and another end of the spring is connected with a bottom of the spring receiving groove 61. A center line of the pin shaft mounting hole 3 and a center line of the spring receiving groove 61 are coincided.

The double-sided usable belt further includes a limiting device 7, the limiting device 7 is disposed between the pin shaft 4 and the buckle head 1 to limit the pin shaft 4, which prevents the pin shaft 4 from sliding out of the pin shaft mounting hole 3 under the action of the spring. The limiting device 7 includes a limiting pin 71 and a limiting hole 72, and the limiting pin 71 is fixedly connected with the pin shaft 4. The limiting hole 72 is disposed on the buckle head 1 and is communicated with the pin shaft mounting hole 3. The limiting pin 71 is disposed inside the limiting hole 72. When the pin shaft 4 is pressed, the limiting pin 71 slides within the limiting hole 72. During installation, the pin shaft 4 is inserted into the pin shaft mounting hole 3, and then the limiting pin 71 is installed to make the pin shaft 4 slide within the limiting hole 72.

The double-sided usable belt buckle further includes a positioning device 8, the positioning device 8 is disposed between the buckle 1 and the tail clamp 2 for positioning and fixing the tail clamp 2 to avoid the tail clamp 2 turning around the pin shaft 4. The positioning device 8 includes a positioning block 81 and a positioning slot 82, and the positioning slot 82 is matched with the positioning block 81. The positioning block 81 is disposed on the tail clamp 2, and the positioning slot 82 is disposed on the buckle head 1. When the connecting convex block 21 is clamped into the connecting groove 11, the positioning block 81 is clamped into the positioning slot 82 to fix the tail clamp 2, so that the tail clamp 2 and the buckle 1 form a whole structure to avoid the tail clamp 2 turning around the pin shaft 4.

A working principle of one embodiment of the present disclosure is as follows:

The connecting groove 11 is disposed on the buckle head 1. The pin shaft mounting hole 3 is disposed on the buckle head 1, and the pin shaft mounting hole 3 is communicated with the connecting groove 11. The pin shaft 4 is inserted into the pin shaft mounting hole 3. The connecting convex block 21 is disposed on the tail clamp 2, and the connecting convex block is matched with the connecting groove 11. The clamping block 44 is disposed on the pin shaft 4, the release groove 31 is disposed on the pin shaft mounting hole 3, and the clamping groove 211 is disposed on the connecting convex block 21. During installation, the connecting convex block 21 is inserted into the connecting groove 11, and the guiding structure 43 of the clamping block 44 cooperates with the side wall of the connecting convex block 21 to guide the clamping block 44 clamp into the clamping groove 211.

The reset device 5 is disposed on the shaft mounting hole 3, before the clamping block 44 is clamped into the clamping groove 211, the clamping block 44 is inserted into the release groove 31 firstly. When the connecting convex block 21 is completely clamped into the connecting groove 11, the reset device 5 push the clamping block out of the pin shaft mounting hole 3, so that the clamping block 44 is clamped into the clamping groove 211 to connect the buckle head 1 with the tail clamp 2. When it is necessary to separate the tail clamp 2 from the buckle head 1, the pin shaft 4 is pressed to make the clamping block 44 insert into the release groove 31, and then the tail clamp 2 is removed. The operation above is simple and convenient, and the double-sided usable belt buckle is quickly installed and disassembled to make both sides of the belt buckle usable.

Embodiment 2

Figure 7:
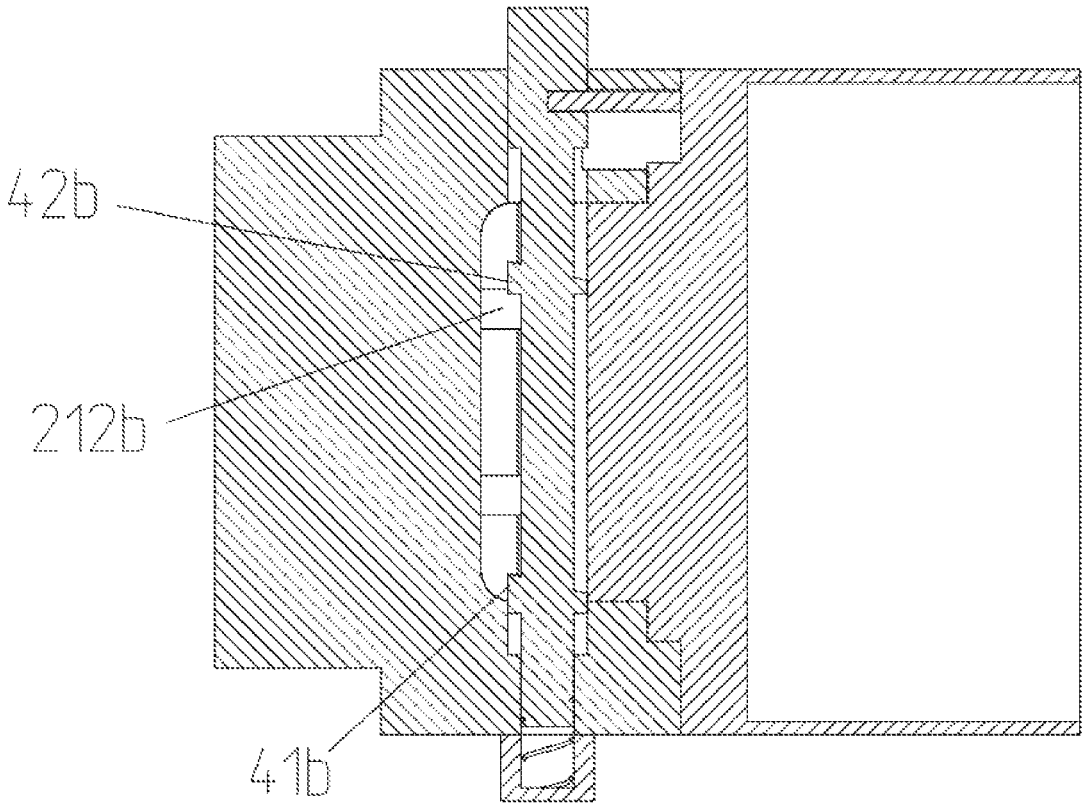
FIG. 7 is a cross-sectional schematic diagram according to a second embodiment of the double-sided usable belt buckle where the double sided usable belt buckle is in the clamping state.
Figure 8:
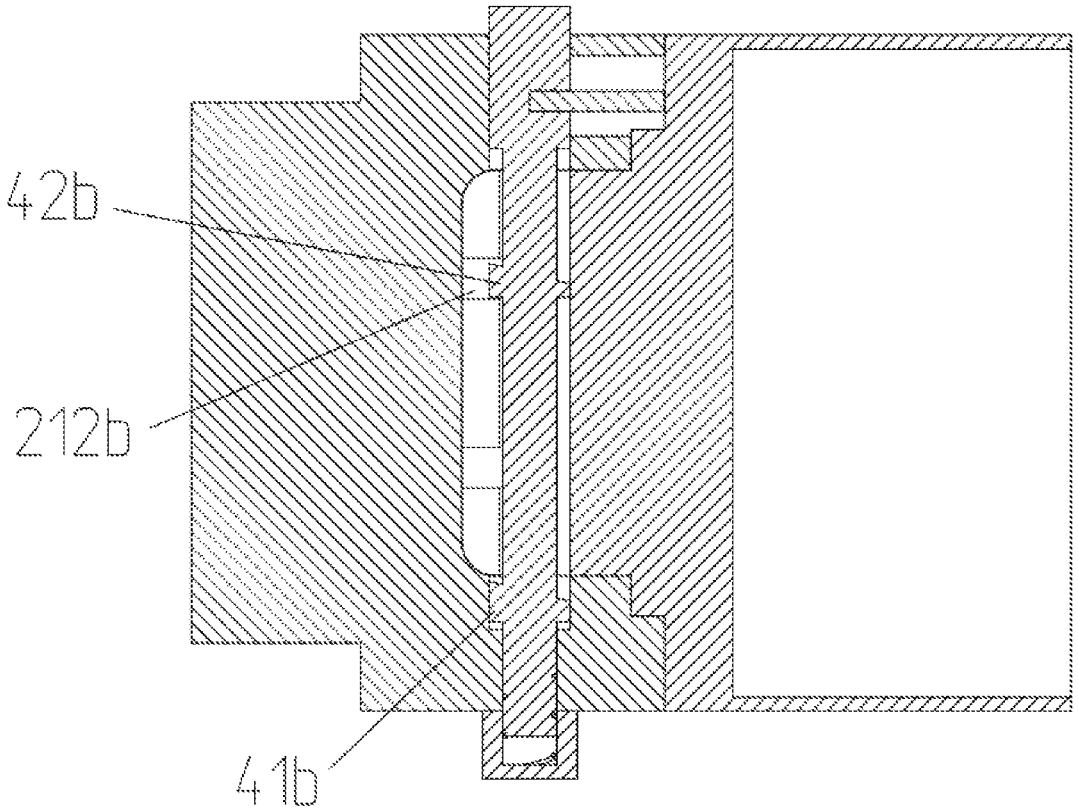
FIG. 8 a schematic diagram according to the second embodiment of the position of the first clamping block and the second clamping block when the tail clamp is separated from the buckle head of the double sided usable belt buckle.
Figure 9:
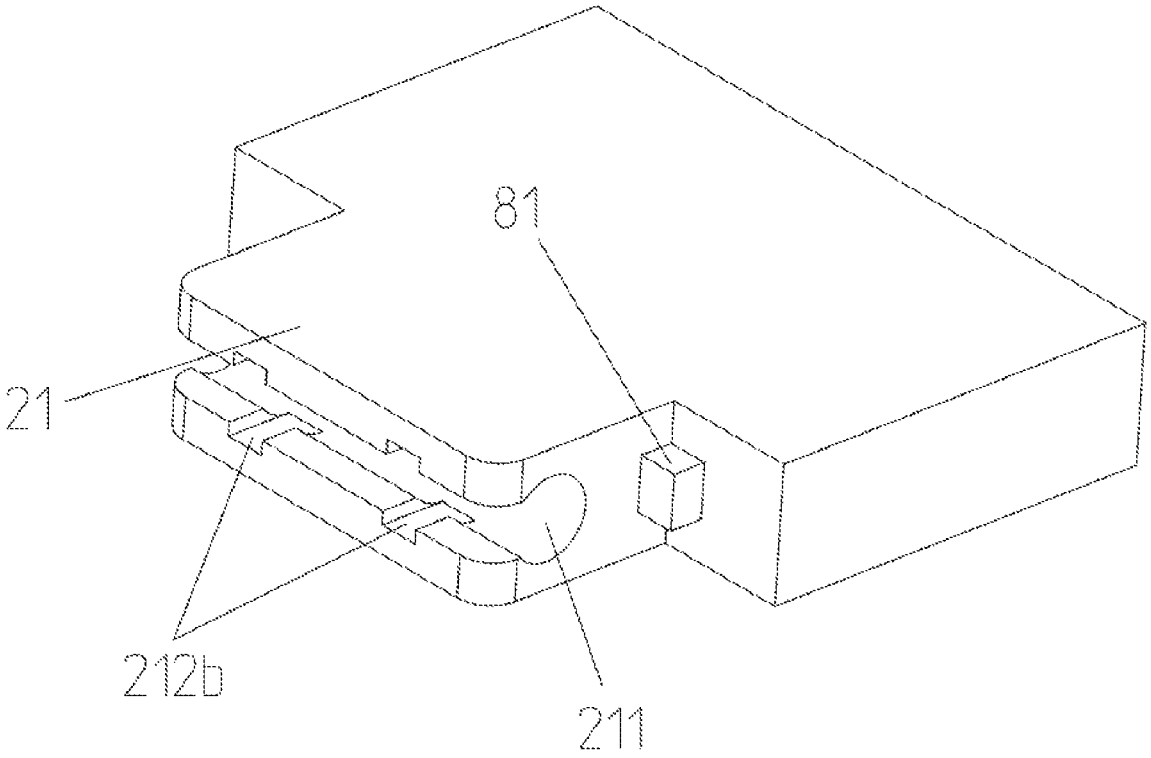
FIG. 9 is a structural schematic diagram according to the second embodiment of the tail clamp of the double-sided usable belt buckle.
Figure 10:
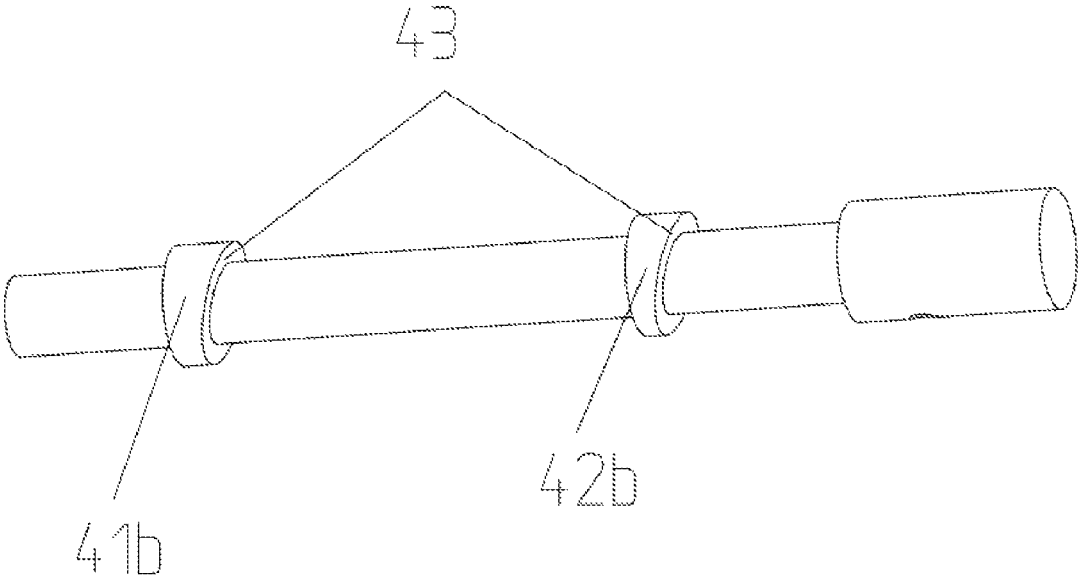
FIG. 10 is a structural schematic diagram according to the second embodiment of the pin shaft of the double-sided usable belt buckle.

As shown in FIGS. 7-10, in the second embodiment, the double-sided usable belt buckle includes the same buckle head 1, the same tail clamp 2, the same pin shaft mounting hole 3, the same pin shaft 4, the same reset device 5, the same fixing base 6, the same limiting device 7, and the same positioning device 8 as the first embodiment. Difference between the first embodiment and the second embodiment is that the double-sided usable belt buckle includes at least two clamping blocks 44. The clamping blocks 44 are disposed on the pin shaft 4. Passing grooves are disposed on the connecting convex block 21 for clamping blocks 44, and the clamping blocks 44 are inserted into the clamping groove 211 through the passing grooves 212*b*.

The clamping blocks 44 include a first clamping block 41*b* and a second clamping block 42*b*. During installation, the first clamping block 41*b* is inserted into the release groove 31 firstly, and then the second clamping block 42*b* is inserted into the clamping groove 211 through the passing grooves 212*b*. The second clamping block 42*b* is separated from the first clamping block 41*b* at a certain distance, and the second clamping block 42*b* is disposed on one end close to a head of the pin shaft 4. When using, the first clamping block 41*b* and the second clamping block 42*b* are respectively clamped on both sides of the connecting convex block 21, so that a connection between the tail clamp 2 and the buckle head 1 is more stable, and a problem of shaking is avoided compared with when only one side of the connecting convex block 21 is clamped. Each of the clamping blocks 44 includes the guiding structure 43. When the connecting convex block 21 is inserted into the connecting groove 11, the guiding structure is connected with the side wall of the connecting convex block 21 and a side wall of corresponding passing groove 212*b* to guide the clamping blocks 44 to clamp into the clamping groove 211.

The present disclosure further provides a belt, the belt includes a belt body and the double-sided usable belt buckle, the belt body is connected with the tail clamp 2 of the double-sided usable belt buckle.

While the foregoing is a description of several condiments of the present disclosure, concepts of the present disclosure are not limited thereto. It is intended that the present disclosure not be limited to the particular embodiment disclosed, but on the contrary, the intention is to cover all such modifications as fall within the scope of the present disclosure.

What is claimed is:

1. A double-sided usable belt buckle, comprising a buckle head (1), a tail clamp (2), a pin shaft (4), and a pin shaft mounting hole (3); wherein a connecting convex block (21) is disposed on the tail clamp (2) in a direction of the buckle head (1); a clamping groove (211) is disposed on the connecting convex block (21); a connecting groove (11) is disposed on the buckle head (1), and the connecting groove (11) is matched with the connecting convex block (21); the pin shaft mounting hole (3) is disposed on the buckle head (1), and the pin shaft mounting hole (3) is communicated with the connecting groove (11), the pin shaft (4) is inserted into the pin shaft mounting hole (3); clamping blocks (44) are disposed on the pin shaft (4); when the buckle head (1) is connected with the tail clamp (2), the clamping blocks (44) are inserted into the pin shaft mounting hole (3), the connecting convex block (21) is inserted into the connecting groove (11), the clamping blocks (44) are clamped into the clamping groove (211) to fix the tail clamp (2).

2. The double-sided usable belt buckle according to claim 1, wherein a number of the clamping blocks (44) is at least two; the clamping blocks (44) are disposed on the pin shaft (4); passing grooves (212*b*) are disposed on the connecting convex block (21) for clamping blocks (44), and the clamping blocks (44) are inserted into the clamping groove (211) through the passing grooves (212*b*).

3. The double-sided usable belt buckle according to claim 2, wherein each of the clamping blocks (44) comprises a guiding structure (43), when the connecting convex block (21) is inserted into the connecting groove (11), the guiding structure is connected with a side wall of the connecting convex block (21) and a side wall of corresponding passing groove (212*b*) to guide the clamping blocks (44) to clamp into the clamping groove (211).

4. The double-sided usable belt buckle according to claim 1, wherein the double-sided usable belt further comprises a reset device (5), the reset device (5) drives the pin shaft (4) to reset after the pin shaft (4) moves in an axial direction; when the pin shaft (4) moves, the clamping blocks (44) pop out of the clamping groove (211); and when the pin shaft (4) is reset, and the clamping blocks (44) are clamped into the clamping groove (211).

5. The double-sided usable belt buckle according to claim 4, wherein the reset device (5) comprises a spring and a fixing base (6), the fixing base (6) is connected with the buckle head (1); a spring receiving groove (61) is disposed on the fixing base (6), and the spring is disposed inside the spring receiving groove (61); a center line of the pin shaft mounting hole (3) and a center line of the spring receiving groove (61) are coincided.

6. The double-sided usable belt buckle according to claim 1, wherein the double-sided usable belt further comprises a limiting device (7), the limiting device (7) is disposed between the pin shaft (4) and the buckle head (1) to limit the pin shaft (4).

7. The double-sided usable belt buckle according to claim 6, wherein the limiting device (7) comprises a limiting pin (71) and a limiting hole (72), and the limiting pin (71) is fixedly connected with the pin shaft (4); the limiting hole (72) is disposed on the buckle head (1) and is communicated with the pin shaft mounting hole (3); the limiting pin (71) is disposed inside the limiting hole (72).

8. The double-sided usable belt buckle according to claim 1, wherein the double-sided usable belt buckle further comprises a positioning device (8), the positioning device (8) is disposed between the buckle head (1) and the tail clamp (2).

9. The double-sided usable belt buckle according to claim 8, wherein the positioning device (8) comprises a positioning block (81) and a positioning slot (82), and the positioning slot (82) is matched with the positioning block (81); the positioning block (81) is disposed on the tail clamp (2), and the positioning slot (82) is disposed on the buckle head (1).

10. A belt, comprising a belt body and a double-sided usable belt buckle; wherein the double-sided usable belt buckle comprises a buckle head (1), a tail clamp (2), a pin shaft (4), and a pin shaft mounting hole (3); wherein a connecting convex block (21) is disposed on the tail clamp (2) in a direction of the buckle head (1); a clamping groove (211) is disposed on the connecting convex block (21); a connecting groove (11) is disposed on the buckle head (1), and the connecting groove (11) is matched with the connecting convex block (21); the pin shaft mounting hole (3) is disposed on the buckle head (1), and the pin shaft mounting hole (3) is communicated with the connecting groove (11), the pin shaft (4) is inserted into the pin shaft mounting hole (3); clamping blocks (44) are disposed on the pin shaft (4); when the buckle head (1) is connected with the tail clamp (2), the clamping blocks (44) are inserted into the pin shaft mounting hole (3), the connecting convex block (21) is inserted into the connecting groove (11), the clamping blocks (44) are clamped into the clamping groove (211) to fix the tail clamp (2).

* * * * *